US009254680B2

(12) United States Patent
Takeuchi et al.

(10) Patent No.: US 9,254,680 B2
(45) Date of Patent: Feb. 9, 2016

(54) TRAY, INK JET TEXTILE PRINTING APPARATUS, STORING METHOD OF TRAY, AND MANUFACTURING METHOD OF PRINTED MATTER

(71) Applicant: SEIKO EPSON CORPORATION, Tokyo (JP)

(72) Inventors: Hideyuki Takeuchi, Shiojiri (JP); Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/835,037

(22) Filed: Mar. 15, 2013

(65) Prior Publication Data

US 2013/0278697 A1 Oct. 24, 2013

(30) Foreign Application Priority Data

Apr. 24, 2012 (JP) ..... 2012-098463

(51) Int. Cl.
*B41J 2/01* (2006.01)
*B41J 3/407* (2006.01)
*B41J 11/06* (2006.01)

(52) U.S. Cl.
CPC ..... *B41J 3/4078* (2013.01); *B41J 11/06* (2013.01)

(58) Field of Classification Search
CPC ..... B41J 3/4078
USPC ..... 347/4, 16, 104
See application file for complete search history.

(56) References Cited

U.S. PATENT DOCUMENTS

| | | | | |
|---|---|---|---|---|
| 4,244,766 | A * | 1/1981 | Yellen | 156/211 |
| 6,631,985 | B2 * | 10/2003 | Koizumi et al. | 347/101 |
| 7,040,748 | B2 | 5/2006 | Niimi et al. | |
| 7,237,890 | B2 | 7/2007 | Niimi et al. | |
| 7,413,301 | B2 | 8/2008 | Niimi et al. | |
| 8,047,646 | B2 * | 11/2011 | Ando et al. | 347/104 |
| 2002/0060728 | A1 * | 5/2002 | Koizumi et al. | 347/101 |
| 2004/0179081 | A1 | 9/2004 | Nimi et al. | |
| 2006/0152568 | A1 | 7/2006 | Niimi et al. | |
| 2006/0203069 | A1 | 9/2006 | Niimi et al. | |
| 2011/0242189 | A1 * | 10/2011 | Okada et al. | 347/20 |
| 2013/0050328 | A1 * | 2/2013 | Yanagishita | 347/16 |

FOREIGN PATENT DOCUMENTS

JP 2004-284305 10/2004

* cited by examiner

*Primary Examiner* — Julian Huffman
*Assistant Examiner* — Sharon A Polk
(74) *Attorney, Agent, or Firm* — Workman Nydegger

(57) ABSTRACT

A tray which is provided so as to be detachable from a support unit of an ink jet textile printing apparatus, and includes a main body having a setting surface on which a material to be printed is set; a positioning pin which is provided in a protruding manner on the mounting surface on the opposite side to the setting surface of the main body, and is used when mounting the main body on the support unit; and a leg portion which is provided in a protruding manner on the mounting surface of the main body, and has a protruding dimension which is longer than the positioning pin.

9 Claims, 9 Drawing Sheets

3A, 3
65
66
7
5
24
67
67a
67b
70A
70B
71
71a
71b
73
73a

TRAY, INK JET TEXTILE PRINTING APPARATUS, STORING METHOD OF TRAY, AND MANUFACTURING METHOD OF PRINTED MATTER

CROSS-REFERENCE TO RELATED APPLICATIONS

The entire disclosure of Japanese Patent Application No. 2012-098463, filed Apr. 24, 2012 is expressly incorporated by reference herein.

BACKGROUND

1. Technical Field

The present invention relates to a tray which is used when setting a fabric, that is, a material to be printed, an ink jet textile printing apparatus including the tray, and a method of manufacturing printed matter.

2. Related Art

In the related art, an ink jet textile printing apparatus has been developed and widely used, which prints a desired image by ejecting ink of each color from an ink ejecting head towards the surface of a material to be printed on, such as a T-shirt or a like fabric.

When placing a target material (on which printing is performed) with respect to such an ink jet textile printing apparatus, a tray is used. The target material is supported by a transporting unit which can perform transporting of the target material toward a textile printing execution region in which an ink ejecting head is present.

In the tray, a long shaft fixed positioning portion is provided with respect to a support unit of the transporting unit so as to protrude to the side of the support unit as disclosed in JP-A-2004-284305 which is described below.

However, as described above, when a long shaft fixed positioning portion is provided in the tray, it is difficult to horizontally place the tray because the tray is disturbed by the long shaft portion even when attempting to place the tray on a flat table by detaching the tray from the support unit since the long shaft portion is in the way.

In addition, it is actually difficult to perform setting work even when trying to set a fabric in the tray which is placed on the table in such an unstable inclined posture. Accordingly, in the related art, it took a long time to set the fabric, since a setting work of resetting a new fabric each time the printing finishes in a state in which the tray is fixed to the support unit has been performed in a setting area of the ink jet textile printing apparatus.

SUMMARY

An advantage of some aspects of the invention is to provide efficiency in a setting work of setting a material to be printed in a tray of an ink jet textile printing apparatus.

According to a first aspect of the invention, there is provided a tray which is provided so as to be detachable from a support unit of an ink jet textile printing apparatus, which includes a main body having a setting surface on which a material to be printed is set; a first protrusion portion which is used when arranging the main body at the support unit by being provided at an opposite side to the setting surface in a protruding manner; and a leg portion which is provided so as to protrude to the side which is opposite to the setting surface, and of which a protruding dimension is longer than that of the first protrusion portion.

Here, "material to be printed" means a "fabric" as a printing target, and includes natural fibers such as cotton, silk, and wool, synthetic fibers such as nylon, textile of composite fibers in which these are mixed, knitted fabrics, non-woven fabrics, or the like, and includes both of a long material which is wound in a roll shape and a material which is cut in the predetermined length. Further, in the material to be printed, a fabric or the like before and after cutting which is present as parts in a state of a fabric before sewing are also included, in addition to a clothes such as a T-shirt after sewing, or kind of furniture such as a handkerchief, a scarf, a towel, a curtain, a sheet, and a bed cover after sewing.

In addition, "being provided by protruding to the side which is opposite to the setting surface" includes both a structure of protruding to the same direction as the protruding direction of the first protrusion unit from the opposite side surface to the setting surface of the main body, and a structure of protruding to the same direction as the protruding direction of the first protrusion unit from the side surface of the main body.

According to the aspect of the invention, since the main body of the tray has the leg portion of which the protruding dimension is longer than that of the first protrusion portion such as the positioning pin, it is possible to horizontally place the tray on a planar portion such as a table by detaching the tray from the support unit of the ink jet textile printing apparatus. In this manner, a setting work of setting a material to be printed in the tray of the ink jet textile printing apparatus becomes easy, and it is possible to efficiently perform the setting work.

In addition, it is also possible to perform the work of setting a material to be printed in the tray in a separate place from the apparatus main body by detaching the tray from the apparatus main body of the ink jet textile printing apparatus, not only in a setting area in the vicinity of the support unit.

Along with this, when the plurality of trays are prepared, and the material to be printed is set in the trays in advance, it is possible to omit the setting work of the material to be printed in the setting area which has been performed each time printing is finished, and to perform the setting work, and the printing of the material to be printed efficiently.

In the tray according to the aspect of the invention, the plurality of leg portions may be provided.

According to the aspect of the invention, it is possible to horizontally place the tray stably on a planar potion such as a table by detaching the tray from the support unit of the ink jet textile printing apparatus, by providing the plurality of leg portions.

In the tray according to the aspect of the invention, the leg portion may have an inclined surface which retreats toward the inside from an end portion of the main body.

According to the aspect of the invention, since the leg portion has the inclined surface which retreats toward the inside from the end portion of the main body, it is possible to perform processing of an end portion of the material to be printed out of the setting surface at the time of a setting work which is performed in the vicinity of the leg portion without being interfered with the presence of the leg portion.

In addition, when setting the material to be printed such as a T-shirt, or the like, so as to be put on the main body in a state in which the tray is mounted on the ink jet textile printing apparatus, it is possible to reduce a concern the material to be printed may be caught by the leg portion when putting the material to be printed on, and workability is improved.

In the tray according to the above described aspect of the invention, the setting surface of the main body may be provided with a concave portion at which the leg portion of another tray which is arranged on the tray is located when the plurality of trays are overlapped.

Specifically, when accumulating the plurality of trays on top of another, a concave portion which is engaged with a leg portion of another tray which is accumulated on the tray is formed on the setting surface of the main body.

Here, it is preferable that a shape of the concave portion be a shallow and smooth concave plane so as not to decrease the same smoothness as the setting surface of the main body.

According to the aspect of the invention, it is possible to store trays in which the material to be printed is not set in a state of being accumulated in a plurality of steps by moving the tray to a separate place such as a floor face or the like, and to prevent position aberration of the trays which are accumulated on top of another by engaging the leg portion with the concave portion, or a collapse of the trays.

In addition, when storing unused trays, it is also possible to improve a storing property in a storing space by accumulating the tray on top of another.

In the tray according to the above described aspect of the invention, a frame which is fitted into the main body in a state of being set with the material to be printed on the setting surface, and maintains the set state of the material to be printed may be included.

According to the aspect of the invention, when the frame for maintaining the set state of the material to be printed on the setting surface is fitted into the main body, since a fitting work is performed in a state in which the main body is raised by the leg portion, the work becomes easy.

According to a second aspect of the invention, there is provided an ink jet textile printing apparatus which includes the tray according to the above described aspect, a support unit at which the tray is detachably mounted, and a printing unit which ejects ink to a material to be printed which is set in the tray.

According to the aspect of the invention, as the ink jet textile printing apparatus, it is possible to obtain the same effect as that in the above described aspect.

The ink jet textile printing apparatus according to the aspect of the invention may further include a movement mechanism which relatively moves the tray and the printing unit in a first direction, in which the tray includes the plurality of trays of which length in the first direction is different, and length of the leg portion in the first direction is shorter than length of a first tray in the first direction of which the length in the first direction is shortest among the plurality of trays.

According to the aspect of the invention, the leg portion does not protrude from the first tray in the first direction, and is easy to use.

In the ink jet textile printing apparatus according to the aspect of the invention, the length of the leg portion in the first direction may be longer than a distance of a second tray of which length in the first direction is longest among the plurality of trays between the first protrusion portion and an end portion in the first direction.

According to the aspect of the invention, in addition to the effect in the aspect of the invention, it is possible to reduce a concern that a user's hands, or a printed matter may come into contact with the first protrusion portion such as a positioning pin or the like, since the first protrusion portion such as the positioning pin is in a state of being covered with the leg portion with respect to the outer side in the periphery of the side, for example.

According to a third aspect of the invention, there is provided a method of storing a tray which includes storing the tray according to the aspect of the invention by accumulating on top of another by placing a leg portion of a tray on top in a concave portion of a tray below.

According to the aspect of the invention, when not using a tray, it is possible to store the tray by accumulating on top of another in a storage place, and to prevent position aberration, or a collapse of the trays which are accumulated on top of another by engaging the leg portion with the concave portion. In addition, the storing property in the storing space is improved by accumulating the tray on top of another.

According to a fourth aspect of the invention, there is provided a manufacturing method of a printed matter which includes setting a material to be printed onto the setting surface in a state in which the tray according to the aspect of the invention is raised using the leg portion by being detached from a support unit of an ink jet textile printing apparatus; arranging the tray in the support unit, subsequently; and executing printing.

According to the aspect of the invention, it is possible to obtain the same effect as the aspect of the invention, and to manufacture many printed matters with good workability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
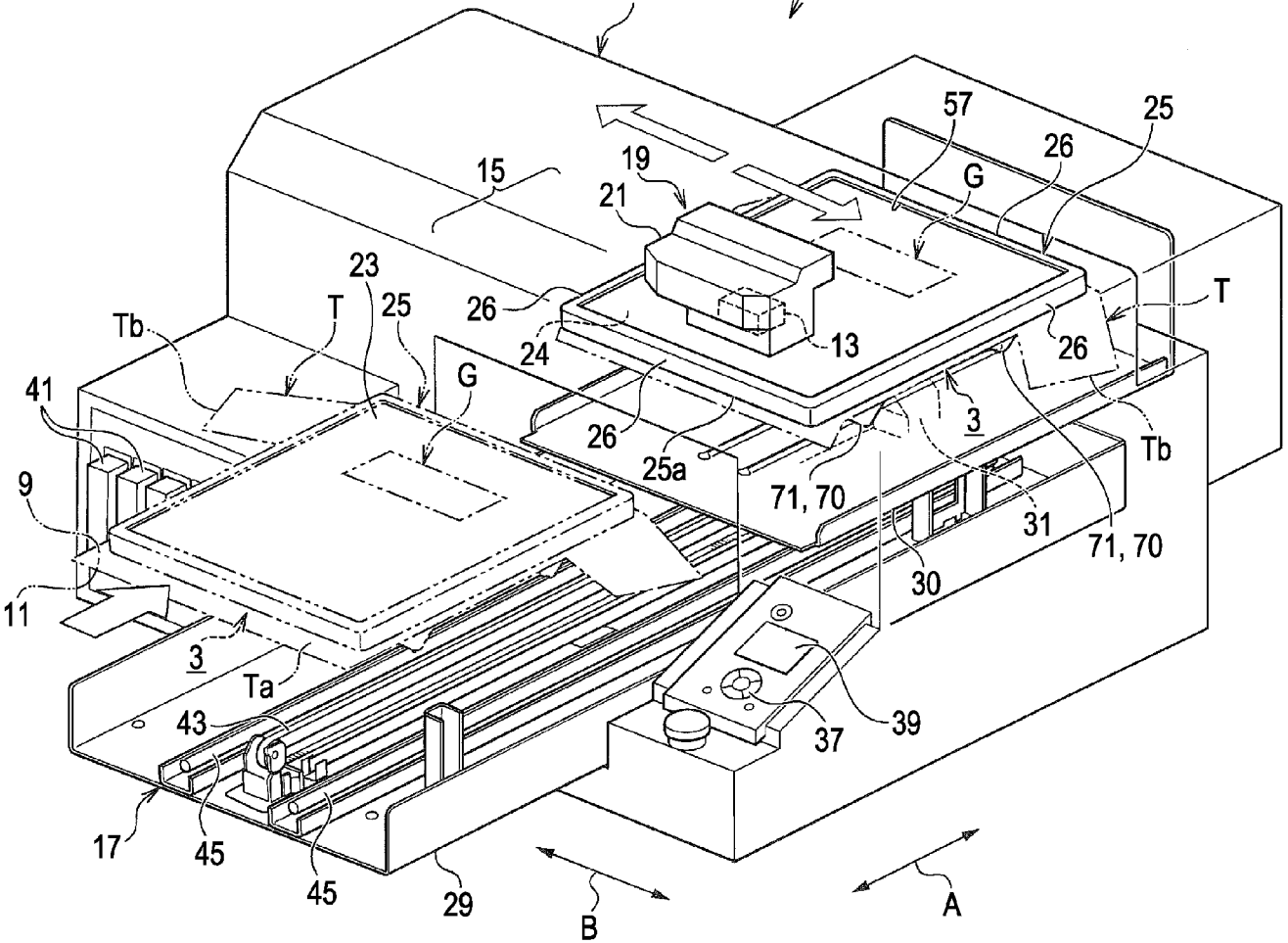
FIG. 1 is a perspective view which illustrates a schematic configuration of an ink jet textile printing apparatus in which a tray according to a first embodiment of the invention is mounted.
Figure 2:
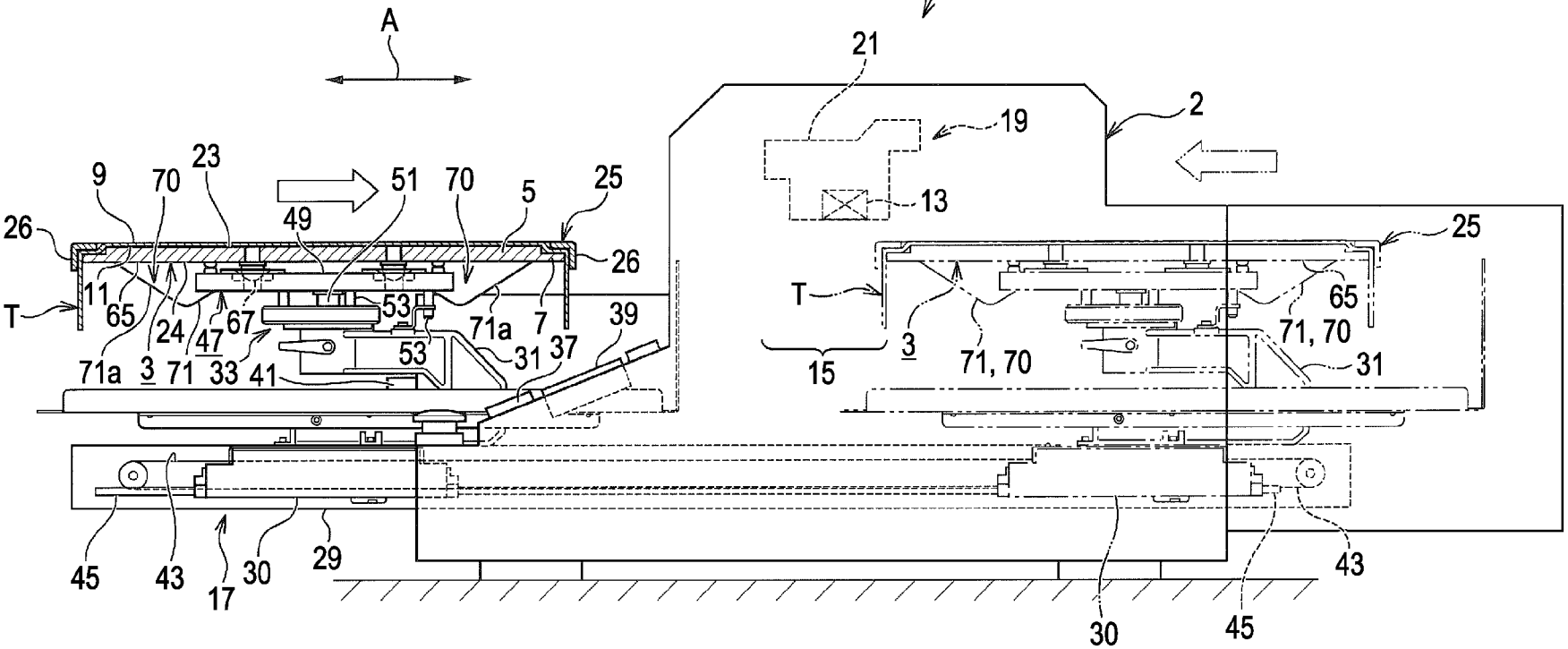
FIG. 2 is a cross-sectional side view which illustrates a schematic configuration of the ink jet textile printing apparatus in which the tray according to the first embodiment of the invention is mounted.
Figure 8:
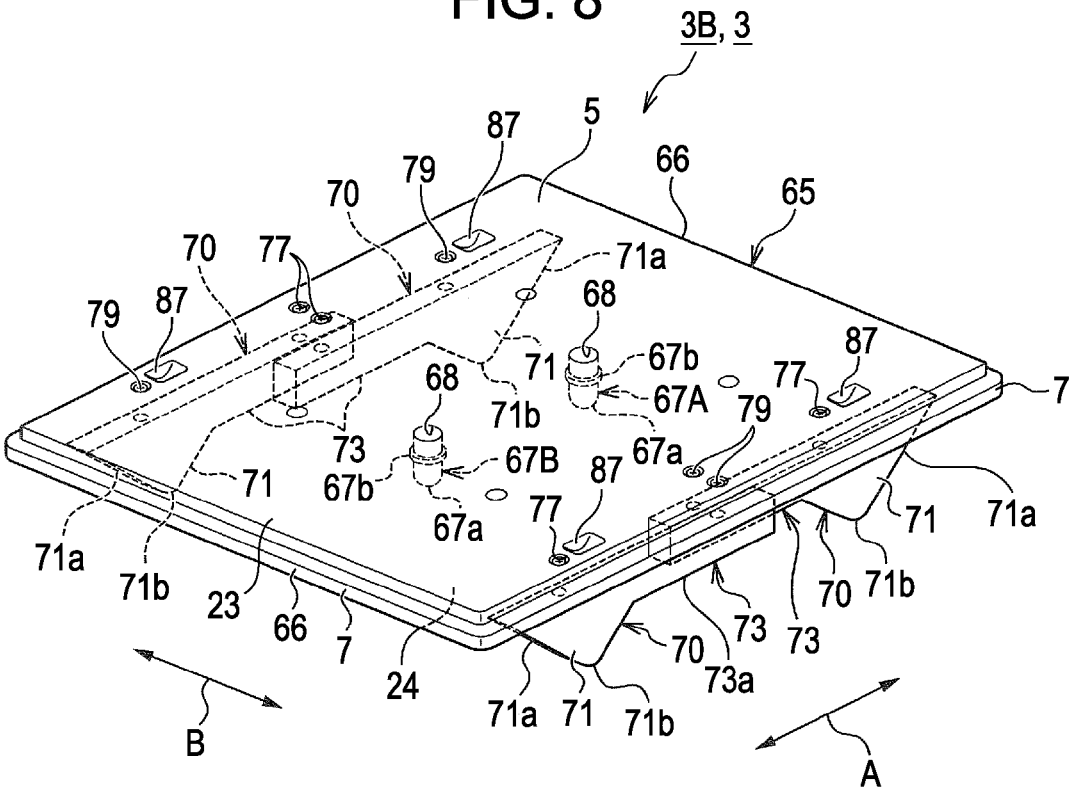
FIG. 8 is a perspective view which illustrates a tray according to a second embodiment of the invention.
Figure 9:
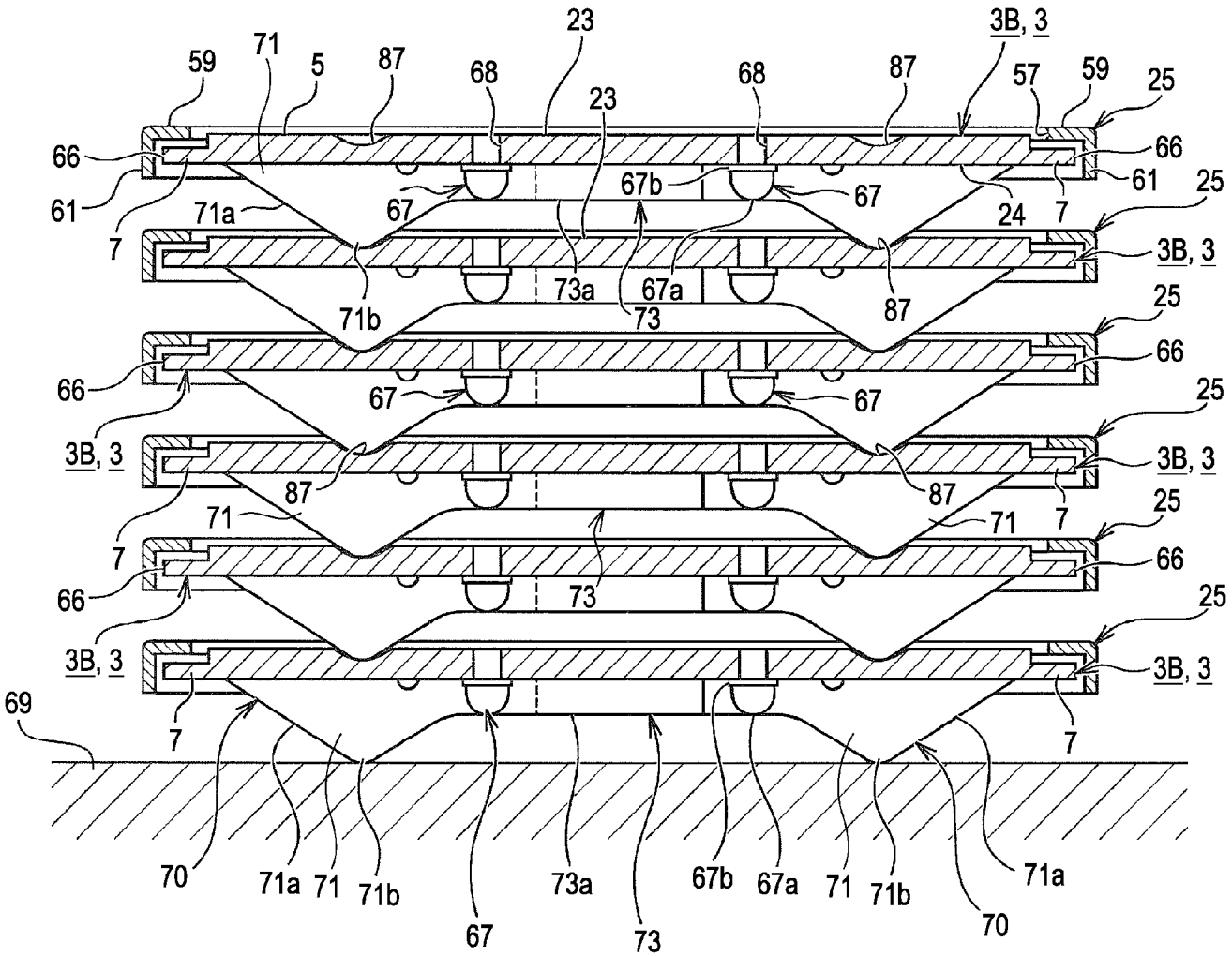
FIG. 9 is a cross-sectional side view which illustrates a state in which the trays according to the second embodiment of the invention are piled up.
Figure 10:
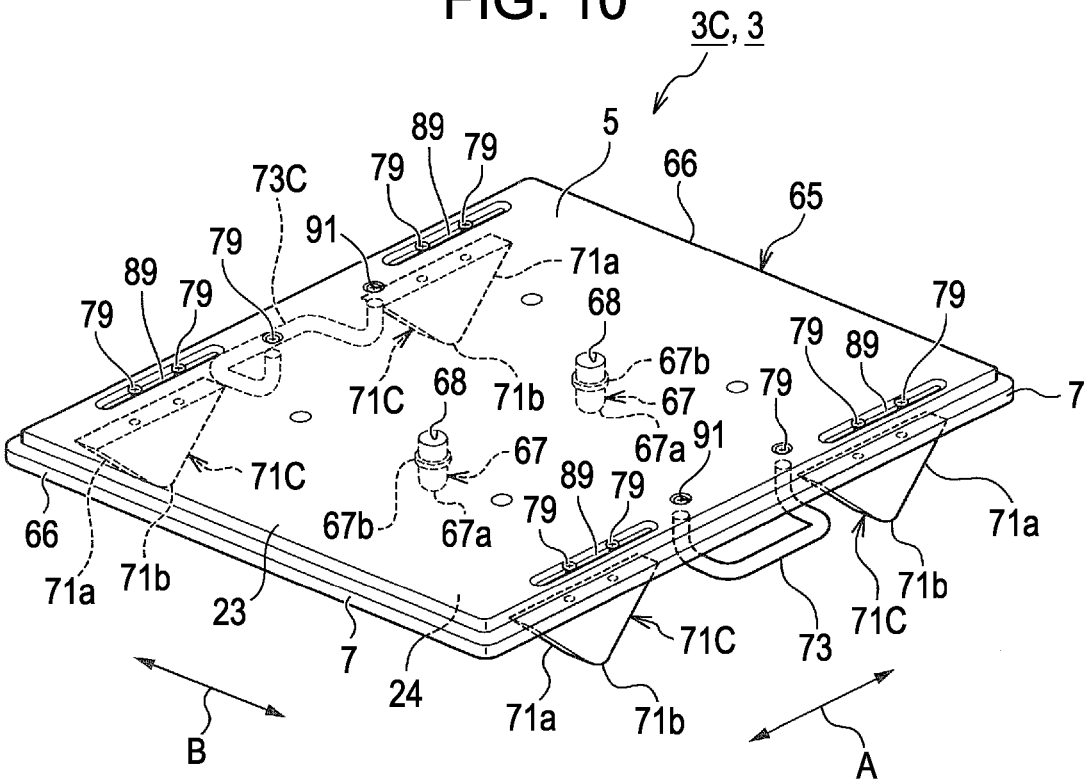
FIG. 10 is a perspective view which illustrates a tray according to a third embodiment of the invention.

A schematic entire configuration of an ink jet textile printing apparatus according to an embodiment of the invention will be described based on FIGS. 1 and 2. Subsequently, a configuration and operations of the tray according to various embodiments will be described based on a first embodiment which is illustrated in FIGS. 3 to 7, a second embodiment which is illustrated in FIGS. 8 and 9, and a third embodiment which is illustrated in FIG. 10.

In addition, in the following descriptions, as a example material to be printed (hereinafter, also referred to as "fabric") T, a T-shirt in which a body portion Ta, and a sleeve portion Tb are sewed into a tubular shape is exemplified. The descriptions of the T-shirt will be made by setting the front surface side (on which a printing image G is formed on the T-shirt) as a first surface 9, and by setting a supported surface on the rear side (which is opposite to the first surface 9) as a second surface 11.

An ink jet textile printing apparatus 1 according to the embodiment is an apparatus which executes printing using an ink jet method. The apparatus 1 includes a tray 3 in which a material to be printed T is set, and an attachment unit 47 which is used for detachably attaching the tray 3 to a support unit 31 of an apparatus main body 2.

In addition, according to the embodiment, the ink jet textile printing apparatus is configured by including the configuration of the tray 3, and the attachment unit 47 separately from the tray 3.

In addition, the ink jet textile printing apparatus 1 includes members which configure a transport unit 17 which transports the material to be printed T (and which is set on the tray 3) along the transport direction A. The apparatus 1 further includes members which configure a printing unit 19 which executes printing by ejecting ink of various colors on the first surface 9 of the material to be printed T as it is guided (along with the above described tray 3 and the attachment unit 47) to a printing executing region 15 by the transport unit 17.

The transport unit 17 includes a support base 29 which extends along the transport direction A. The transport unit 17 further includes a slider 30 which reciprocates along the transport direction A at the upper part of the support base 29 (for example, at a center portion in the width direction B). The transport unit 17 also includes the support unit 31 which extends upward by being mounted on the slider 30, a timing belt 43 which drives the slider 30, a motor which drives the timing belt 43 (not shown), and a guide rod 45 which guides a movement of the slider 30 in the transport direction A.

The attachment unit 47 (which will be described below) is provided through a connection mechanism 33 at the upper part of the support unit 31. The tray 3 (which will be described below) is detachably mounted thereon through the attachment unit 47.

The printing unit 19 includes a carriage 21 which reciprocates in the width direction B of the apparatus main body 2. The width direction B (the "movement direction") is perpendicular to the transport direction A of the material to be printed T. The printing unit further includes an ink ejecting head 13 which is mounted on the carriage 21, and executes printing by ejecting ink of various colors toward the first surface 9 of the material to be printed T which is present in the printing executing region 15.

In addition, an ink cartridge 41 is a constituent member of the above described printing unit 19. The ink cartridge 41 supplies ink of various colors to the ink ejecting head 13 through an ink tube (not shown), and is provided on the left side (FIG. 1) of the apparatus main body 2 when viewed from the front.

In addition, on the right side (viewed from the front) of the apparatus main body 2 are provided an operation button 37 (which execute various operations of the ink jet textile printing apparatus 1), and a display unit 39 (which displays setting information relating to the ink jet printing, or various messages).

First Embodiment

Referencing FIGS. 3 to 7

A tray 3A according to a first embodiment (hereinafter, described as trays 3A, 3B, and 3C, respectively when classifying each of embodiments 1 to 3) includes a main body 65 which has a setting surface 23 on which the material to be printed T is set. As a first protrusion portion, the tray 3A also includes a positioning pin 67 is provided in a protruding manner at a mounting surface 24, which is the opposite side to the setting surface 23 of the main body 65. The positioning pin is used when mounting the main body 65 to the support unit 31. The tray 3A also includes a leg portion 71 which is provided in a protruding manner on the mounting surface 24 of the main body 65, and which leg portion 71 has a protruding dimension that is longer than the positioning pin 67.

That is, the tray 3A includes the leg portion 71 which horizontally supports the main body 65 in a state in which a tip end 67*a* of the positioning pin 67 does not come into contact with a planar portion 69 (FIG. 6, such as a table), when the main body 65 is horizontally placed on the planar portion 69.

In addition, the tray 3A is detachably provided with respect to the support unit 31 of the apparatus main body 2.

Figure 3:
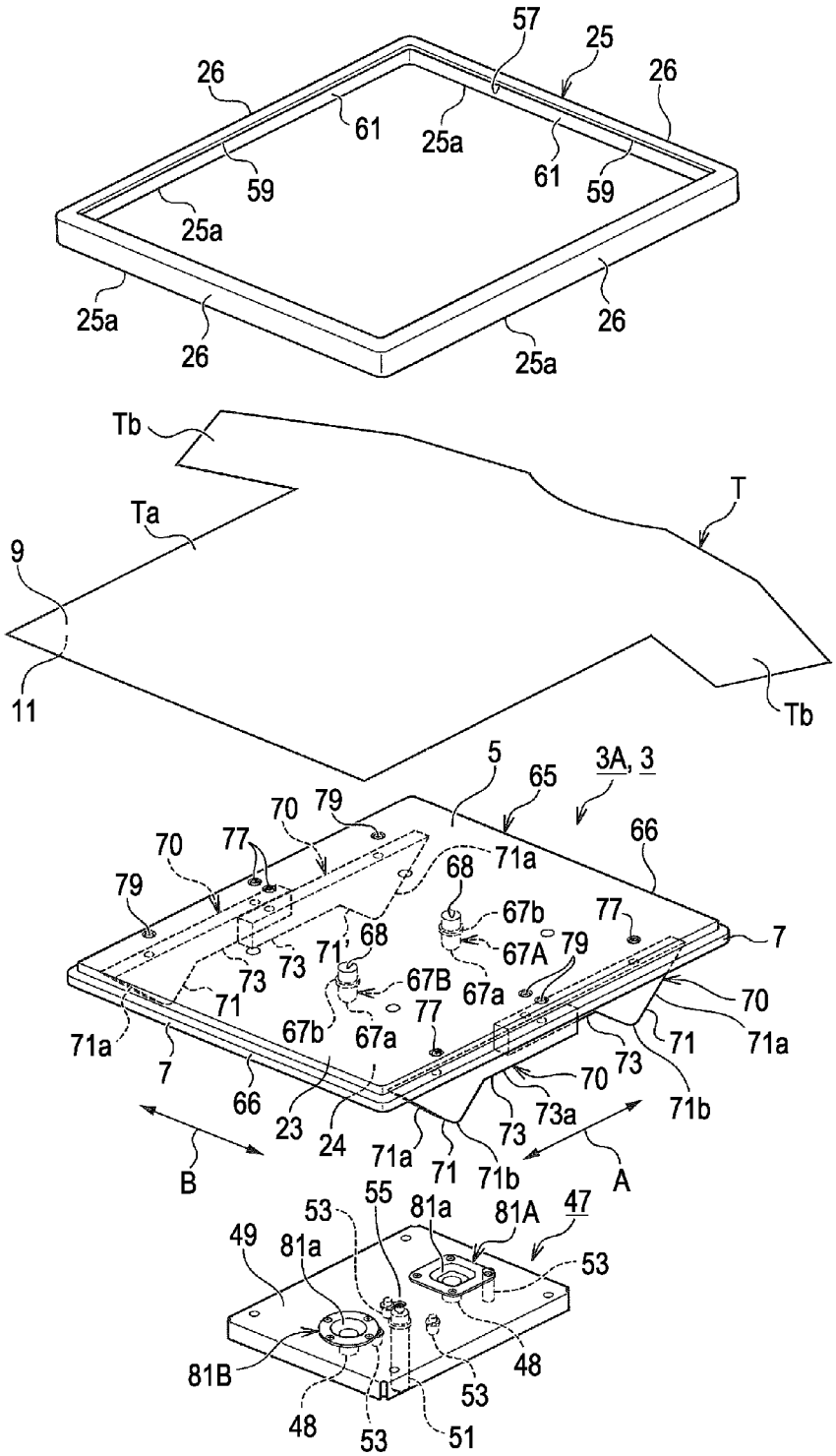
FIG. 3 is an exploded perspective view which illustrates an attaching attachment, and the tray according to the first embodiment of the invention.

In addition, as illustrated in FIG. 3, according to the embodiment, the main body 65 is a member which is formed in a rectangular flat shape of which corner portions are processed to be rounded. The peripheral four sides of the main body 65 are formed with an edge portion 7 which is formed to be thinner than a main body portion 5 at the center, and is formed in an outer flange shape which is projected outward in the horizontal direction.

In addition, a top face of the main body portion 5 of the main body 65 is set as the setting surface 23 where the second surface 11 of the material to be printed T is supported from below, and the lower surface of the main body portion 5 is set as the mounting surface 24 on which the attachment unit 47 (which will be described later) is mounted.

In addition, according to the embodiment, it is configured such that the edge portion 7 of the main body 65 is attached with a fitted-in frame 25 as illustrated in FIG. 3, which fixes the material to be printed T on the main body 65 in a state in which the material to be printed is positioned at a predetermined set position.

A squared window portion 57 (towards which the main body portion 5 of the main body 65 is positioned) is formed in the frame 25. That is, the frame 25 is configured by a member having a rectangular frame shape of which peripheral four sides in which the window portion 57 is formed at the center are surrounded by four frame elements 26 having L-shaped cross sections.

In addition, in the four frame elements 26, a step portion 59 is provided having an inner flange shape which faces the top face of the edge portion 7 of the above described main body 65. Further, a side plate portion 61 is provided which faces the side surface of the edge portion 7 of the above described main body 65.

In addition, two holes 68 for attaching the positioning pin 67 (which will be described later) are formed at the center of the main body 65. In the vicinity of two sides of the main body 65 on left and right in the width direction B, attaching holes 77 (which are used when attaching the leg portion unit 70 which will be described later) are formed by 4 on the left and right sides by being slid in line by two.

The leg portion unit 70 in FIG. 3 is in a state in which the unit is not yet attached to the main body 65.

The positioning pin 67 which is provided with respect to the mounting surface 24 of the main body 65 is a shaft member of which the tip end 67*a* has a circular cross-sectional shape which is processed in a spherical shape so as to be rounded, and of which a diameter is thick.

In addition, the outer flange portion 67*b* is formed in the middle of the positioning pin 67. A portion (on the base end side from the outer flange portion 67*b*) is embedded in the hole 68 which is formed at the center of the main body 65. In addition, the outer flange portion 67*b* may not be provided.

The leg portion 71 is configured by a flat member having a triangular shape when viewed from the side, and is located at the inner side of one end portion 66 of the main body 65. In addition, the leg portion 71 has an inclined surface 71*a* which retreats toward the inside from the end portion 66 of the main body 65. That is, the outer surface of the leg portion 71 becomes the inclined surface 71*a* which is able to guide a movement of the material to be printed T which is mounted from the end portion 66.

Figure 4:
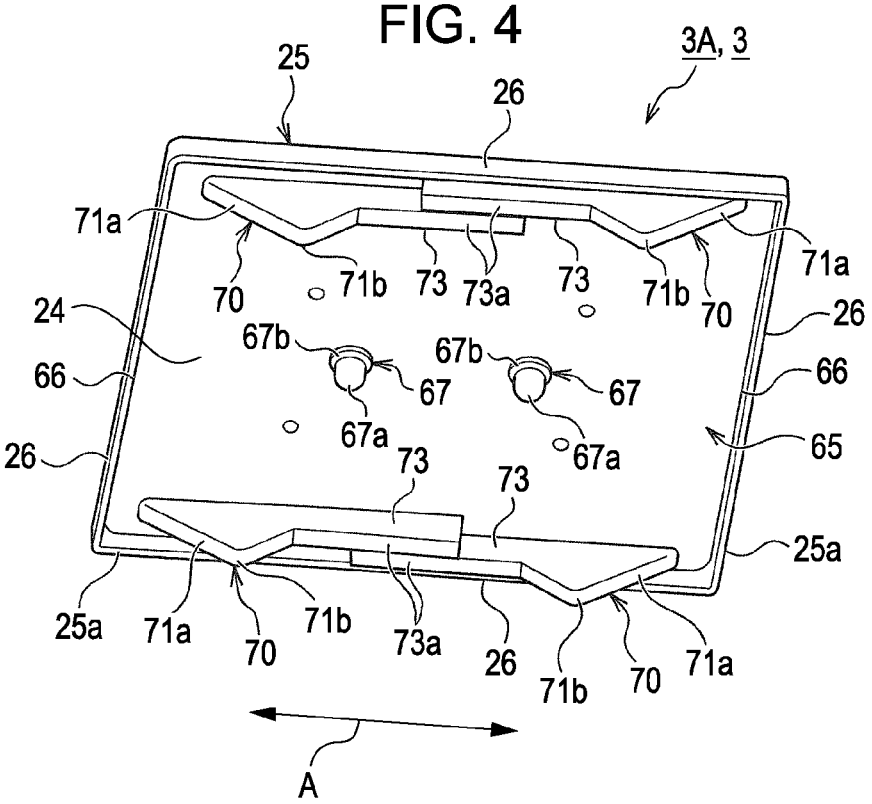
FIG. 4 is a perspective view which illustrates the tray according to the first embodiment of the invention which is obliquely seen from below.
Figure 6:
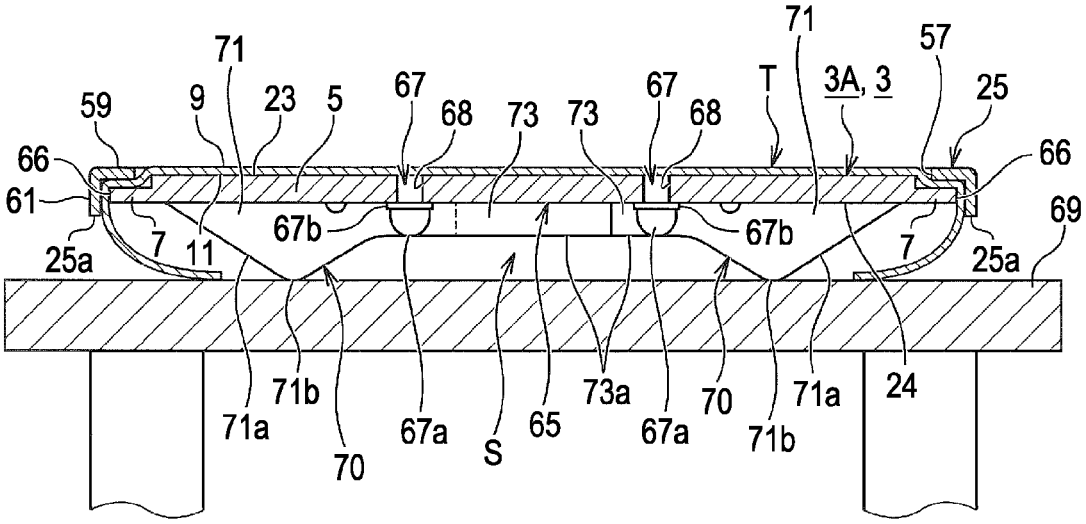
FIG. 6 is a cross-sectional side view which illustrates a state in which the tray according to the first embodiment of the invention is horizontally placed on a planar portion.

As illustrated in FIGS. 4 and 6, since the inclined surfaces 71*a* are provided at antero-posterior sides in the tray movement direction, it is possible to obtain an effect of reducing influence of air when moving, compared to a structure which vertically extends in the vertical direction.

The leg portion 71 is provided between the end portion 66 and the positioning pin 67 in the tray moving direction (transport direction A).

In addition, according to the embodiment, a square bar-shaped member is formed toward the inside from the inner inclined surface of the leg portion 71. The square bar-shaped member is configured so as to function as a grip portion 73 which is used when a user carries the tray 3A by taking the portion using hands.

In addition, as illustrated in FIG. 6, in a state in which the tray 3A is horizontally placed on the planar portion 69 (such as a table), the space S (where hands of a worker enter) is formed between the grip portion 73 and the planar portion 69.

In addition, in the state in which the tray 3A to which the fixing frame 25 is attached is horizontally placed on the planar portion 69, a base 73*a* of the grip portion 73 is located at the planar portion 69 side (the lower side) of a base 25*a* of the fixing frame 25.

In addition, it is configured such that the base 73*a* side of the grip portion 73 is positioned on the planar portion 69 side rather than the base 25*a* side of the frame 25 in a state in which the tray 3A (which is attached to the frame 25) is horizontally placed on the planar portion 69.

Further, a screw aperture is provided on the top face side of the leg portion unit 70 in which the leg portion 71 and the grip portion 73 are integrally formed.

In addition, the screw aperture is screwed with a fixing screw 79 which is inserted from the upper part of the attaching hole 77 which is formed in the vicinity of two sides on the left and right of the above described main body 65 in the width direction B, and four sets of the leg portion unit 70 are attached to a predetermined position of the mounting surface 24 of the main body 65 in bilateral symmetry.

Figures 7A, 7B, 7C:
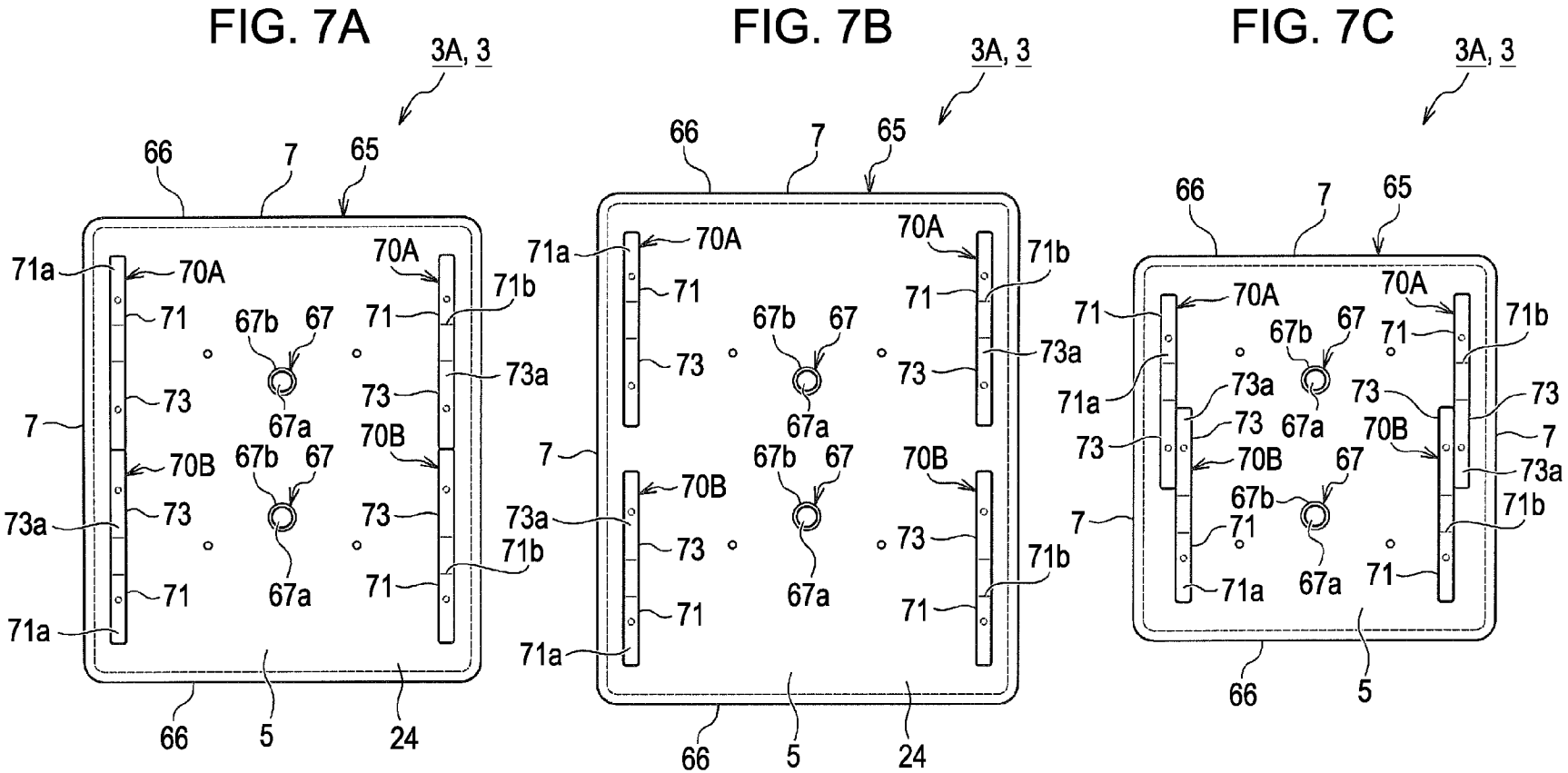
FIGS. 7A, 7B, and 7C are bottom views which illustrate attaching states of a leg portion unit in the tray according to the first embodiment of the invention.

In addition, an attaching position (with respect to the mounting surface 24 of the main body 65 of the leg portion unit 70) can be appropriately changed to attaching modes which are illustrated in FIGS. 7A to 7C.

FIG. 7A illustrates an attaching mode in which, in a state in which the tray 3A is mounted on the support unit 31, a leg portion unit 70A (which is arranged at the front side as a side to which a worker access), and a leg portion unit 70B (which is arranged at the rear side) are connected in the tray 3A.

FIG. 7B illustrates an attaching mode in which the leg portion unit 70A (which is arranged at the front side), and a leg portion unit 70B (which is arranged at the rear side) are separated. Here, "connected" means that at least a part of an end portion of the leg portion unit 70A on the rear side comes into contact with at least a part of an end portion of the leg portion unit 70B on the front side.

In addition, FIG. 7C illustrates an attaching mode in which a part of the leg portion unit 70A (which is arranged at the front side) is overlapped with a part of the leg portion unit 70B (which is arranged at the rear side). It is possible to appropriately select these attaching modes by switching thereof according to a size or the like of the main body 65 to be used.

In FIG. 7, it is preferable that the positioning pin 67 and the grip portion 73 are arranged by being overlapped with each other in the width direction. In addition, at least a part thereof may be overlapped with each other. In this manner, it is possible to reduce a concern that user's hands, or a printed matter may come into contact with the positioning pin 67. The grip portion 73 functions as a bulwark.

It is also possible to use two leg portions on one side with respect to the plurality of trays of which sizes are different. In this case, it is preferable that the length of the leg portion unit 70 (one leg portion 71 and one grip portion 73) in the front-back direction (transport direction A) as the first direction is the length of a minimum-sized tray or less, and the shortest distance between positioning pin 67 and the end portion 66 in a maximum-sized tray, or more.

Due to this, it is easy to use the leg portion unit, since the leg portion unit 70 (one leg portion 71 and one grip portion 73) does not protrude from the minimum-sized tray (first tray) in the first direction. In addition, it is possible to reduce a concern that the user's hands, or the printed matter may come into contact with the positioning pin 67, since the positioning pin 67 is in a state of being covered with the leg portion unit 70 (one leg portion 71 and one grip portion 73).

In addition, the shortest distance is the shortest distance between the positioning pin 67 and the end portion 66 which is closest from each positioning pin 67 in the front-back direction (transport direction A). The distance may be a distance from the center of the positioning pin 67, or may be a distance from a portion which is the farthest from a point of the end portion 66 as a target between the positioning pin 67 and the outer flange portion 67*b*.

A shape of the main body 65 of the tray 3 is not limited to the rectangular shape which is illustrated in the embodiment. It is also possible to apply the embodiment of the present invention to a pentagon, a hexagon, a heptagon, an octagon, or the like.

Figure 5:
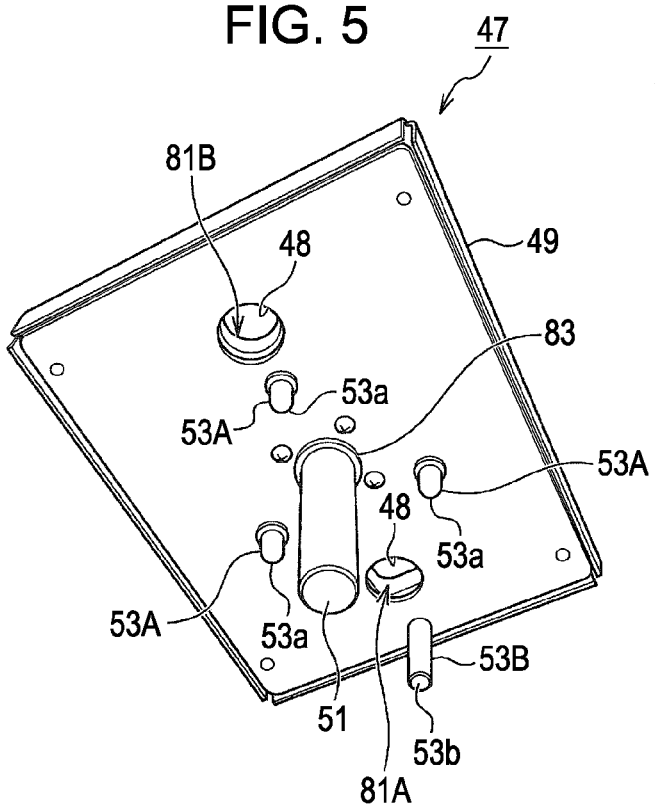
FIG. 5 is a perspective view which illustrates the attaching attachment according to the first embodiment of the invention which is obliquely seen from below.

In addition, as illustrated in FIG. 5, the attachment unit 47 (which is used for attaching the tray 3 to the support unit 31 of the apparatus main body 2) includes an attaching plate 49. The attaching plate 49 has a hole 48 to be fitted with the positioning pin 67 of the tray 3. The attaching plate 49 further has a positioning shaft portion 51 which protrudes to the support unit 31 side of the apparatus main body 2 from a center of the attaching plate 49.

In addition, in the illustrated embodiment, four positioning pins 53 (three positioning pin 53A and one positioning pin 53B) in total are provided at positions in the periphery of the positioning shaft portion 51, and in the vicinity of a central front end. The attachment unit 47 is attached to the support unit 31 through the connection mechanism 33 using these four positioning pins 53, and the positioning shaft portion 51.

The attaching plate 49 is a rectangular planar member which is smaller than the main body 65 of the tray 3, and for example, is formed by appropriately folding a metal flat plate material.

The attaching plate 49 is attached with bearing members 81A and 81B for supporting two positioning pins 67A and 67B (two positioning pins 67 are classified by being attached with A and B) which protrude from the mounting surface 24 of the tray 3A, on the top face side on which the tray 3A is mounted. Inclined surfaces 81*a* and 81*a* (which become narrower in the downward direction) and guide insertion of the positioning pins 67A and 67B are formed at an opening portion on the insertion side of these bearing members 81A and 81B (two bearing members 81 are classified by being associated with suffixes A and B). In addition, the holes 48 and 48 are formed in a penetrating state from the lower end portion of these inclined surfaces 81*a* and 81*a* to the base of the attaching plate 49.

The above described positioning shaft portion 51 (which has a long circular cross-sectional shape, and of which the diameter is thick) is provided (so as to be protruded on the support unit 31 side) at the center of the base of the attaching plate 49 which is attached to the support unit 31.

A base end portion of the positioning shaft portion 51 is supported by the bearing member 83 (FIG. 5) which is accommodated in the attaching plate 49. The positioning shaft portion is attached to the attaching plate 49 by tightening a fixing bolt which is inserted from a hole 55 which is formed at the center of the attaching plate 49 on the top face side.

In addition, the three positioning pins 53A which are provided in the periphery of the positioning shaft portion 51 are short round rod-shaped members of which diameters are smaller than that of the positioning shaft portion 51, and a tip end 53*a* of the positioning pin 53A is processed to be spherical. On the other hand, the positioning pin 53B (which is close to the front end of the attaching plate 49) is a long round rod-shaped member of which a diameter is small, and a tip end 53*b* is processed to be chamfered.

Subsequently, operations of the tray 3A will be described according to a flow of operations from a setting operation of the material to be printed T which is performed using the above described tray 3A and the attachment unit 47 to mounting of the tray 3A with respect to the apparatus main body 2.

1. When Performing Setting Operation

The setting operation of the material to be printed T in the tray 3A is performed by placing the tray 3A on a planar portion 69 (FIG. 6) on a table, or the like. According to the embodiment, in this case, the above described attachment unit 47 is provided with the positioning shaft portion 51, thus excluding the long positioning shaft portion 51 from the configuration of the tray 3A. In addition, the tray 3A is provided with the above described leg portion unit 70. In this manner, it is possible to place the tray 3A on the planar portion 69 in a state in which the main body 65 is horizontally supported.

Accordingly, it is not necessary to set the material to be printed T in an unstable posture in which the main body 65 is inclined, and it is possible to set the material to be printed T in a stable posture in which the main body 65 is horizontally supported. Accordingly, it is possible to perform an efficient setting work of the material to be printed T, and to reduce a labor of a worker.

In addition, the material to be printed T (which is set with respect to the setting surface 23 of the tray 3A in this manner is positioned at a predetermined setting position), is inserted between the step portion 59 and the side plate portion 61 of the frame 25 and the edge portion 7 of the tray 3A by inserting the frame 25 from above, the frame 25 being further fixed to the tray 3A.

In addition, prior to the ink jet printing, it is possible to finish setting work of a plurality of pieces of materials to be printed T in advance. Thus may be done by preparing a plurality of trays 3A (which are configured as above). In such a case, the setting work of the material to be printed T, and a fixing work using the frame 25 are repeatedly performed by the number of necessary pieces.

In addition, according to the embodiment, it is possible to treat an end portion of the material to be printed T (which protrudes to the outside of the setting surface 23 when performing the setting work which is performed in the periphery of the leg portion 71) without being hindered by the presence of the leg portion 71. This is because the leg portion 71 is provided inside the end edge portion 66 of the tray 3A, and because the inclined surface 71*a* is formed at the outside of the leg portion 71.

In addition, when the material to be printed T (such as a T-shirt, or the like) is set so as to be put on the main body 65 in a state in which the tray 3A is arranged at the support unit 31 of the ink jet textile printing apparatus, a concern that the material to be printed may be caught by the leg portion 71 when causing the material to be printed to be put on is reduced, and workability is improved.

In addition, according to the embodiment, it is possible to correspond to main bodies 65 with various sizes using leg portion units 70 having the same configuration. This may be done by attaching the leg portion unit 70 by changing an attaching position with respect to trays with different sizes. Accordingly, by communizing the leg portion unit 70, it is possible to reduce cost of components, and a problem of false mounting of the leg portion unit 70 (which is caused when providing the plurality of leg portion units 70) is reduced.

2. When Carrying

When the tray 3A in which the material to be printed T is set in this manner is used as is, the tray 3A is carried to the support unit 31 of the ink jet textile printing apparatus 1. When the tray is temporarily stored in a storing space or the like, the tray is carried to the storing space.

When the tray 3A is carried, hands are put into the space S which is formed between the grip portions 73 and 73 on the left and right sides and the planar portion 69 (FIG. 6) from the outside, and the grip portions 73 and 73 on the left and right sides are raised upward by being grabbed.

In addition, according to the embodiment, at this time, since it is configured such that the base 73*a* side of the grip portion 73 is located at the planar portion 69 side rather than the base 25*a* of the frame 25, a concern that only the frame 25 may be carelessly held up by hands which act first on the base 25*a* of the frame 25 is reduced.

In addition, by providing such a grip portion 73, it is possible to easily carry the tray 3A, and to carry the tray 3A to a desired position by reliably holding the tray 3A.

3. Mounting onto Support Unit

The tray 3A (which is carried to the support unit 31 of the ink jet textile printing apparatus 1 in this manner) is mounted on the attachment unit 47 (which is attached to the support unit 31) in the following manner.

The tray 3A (which is carried to the support unit 31 which is present in a setting area by being held at the grip portion 73) causes the two positioning pins 67 and 67 (which protrude from the mounting surface 24 of the main body 65) to be fitted into the fitting holes 48 and 48, by being inserted, which are formed on the attaching plate 49 while being guided to the inclined surfaces 81*a* and 81*a* of the bearing members 81 and 81 which are attached to the top face of the attaching plate 49 of the attachment unit 47.

In addition, positioning of the tray 3A with respect to the attachment unit 47 is performed when the two positioning pins 67 and 67 are fitted into the two fitting holes 48 and 48, and a fixing state of the tray 3A with respect to the attachment unit 47 is settled due to the own weight of the tray 3A, since the tray 3A itself has a corresponding weight.

Accordingly, the fixing state is also maintained with respect to a movement of transport unit 17 of the ink jet textile printing apparatus 1, and ink jet printing by the printing unit 19 is performed.

Second Embodiment

Refer to FIGS. 8 and 9

In a tray 3B according to a second embodiment, only a part of configurations in a main body 65 is different from the tray 3A according to the first embodiment, and other configurations than that are the same as those in the first embodiment.

Accordingly, here, descriptions of the same configurations as those in the first embodiment are omitted. A configuration of the tray 3B according to the second embodiment, a form of use, and the operation which are executed when using the tray 3B will be described mainly based on the configuration of the main body 65 which is different from that in the first embodiment.

That is, according to the embodiment, as illustrated in FIG. 8, four concave portions 87 (at which a leg portion 71 of another tray 3B which is accumulated on the tray 3B is arranged) are formed corresponding to the number of leg portions 71 and positions on a setting surface 23 of the main body 65. Here, it is preferable that the shape of the concave portion 87 is formed in a shallow and smooth concave plane so as not to decrease the same smoothness as the setting surface 23 of the main body 65 (in FIG. 8, concave portion 87 is largely illustrated for easy understanding).

The concave portion 87 has the depth in which a tip end portion 71*b* of the leg portion 71 can be accommodated, and is formed by a concave portion which has the same shape as the tip end portion 71*b* of the leg portion 71, and is slightly larger than the tip end portion 71*b*.

It is preferable that the depth of the concave portion 87 has the thickness of the main body 65 or less, since the concave portion is formed on the surface of the tray. In addition, it is preferable that the depth of the concave portion 87 is ½ of the thickness of the main body 65 or less, when considering deterioration in strength of the main body 65. In addition, since there is a concern that both of the tip end portion 71*b* of the leg portion 71 and the concave portion 87 may be sharpened due to a contact with each other (depending on the material), the concave portion may be a through hole which penetrates the base of the main body 65. It is preferable to form the concave portions 87 on the outer side of a printing region.

In addition, when using the tray 3B configured in this manner, since the tip end portion 71*b* of the leg portion 71 of the upper tray 3B is arranged at the concave portion 87 which is formed on the setting surface 23 of the lower tray 3B when the plurality of sets of tray 3B are accumulated as illustrated in FIG. 9, the accumulated state of the tray 3B becomes strong, and position aberration of the tray 3B in each step, or a collapse of the tray 3B is suppressed.

In addition, a storing efficiency of the tray 3B is improved compared to a structure in which accumulation is not possible, by accumulating the plurality of sets of tray 3B. Here, the storing efficiency means the number of trays per unit area.

Third Embodiment

Refer to FIG. 10

In a tray 3C according to a third embodiment, configurations of a main body 65, a leg portion 71C (reference numeral C is attached in order to distinguish from that in first embodiment), and a grip portion 73C (reference numeral C is attached in order to distinguish from that in first embodiment) are different from the tray 3A according to the first embodiment, and other configurations than those are the same as those in the first embodiment.

Accordingly, here, descriptions of the same configurations as those in the first embodiment are omitted. A configuration of the tray 3B according to the third embodiment, and operation thereof will be described mainly based on the configurations of the main body 65, the leg portion 71C, and the grip portion 73C which are different from those in the first embodiment.

That is, according to the embodiment, as illustrated in FIG. 10, the grip portion 73C and the leg portion 71C are configured by separate members. The main body 65 of the tray 3 is provided with a long hole 89 which can adjust an attaching position of the leg portion 71C in a predetermined range in the front-back direction instead of the attaching hole 77 which is provided according to the first embodiment.

Specifically, the leg portion 71C is configured by a planar member which is triangular when viewed from the side, and screw apertures are formed on the top face of the leg portion 71C by two.

The grip portion 73C is configured by a handle-like member in which a rod member (which is bent in a gate shape) is protruded toward the lower part from the mounting surface 24 of the main body 65, and is bent toward the outside on the side.

In addition, the main body 65 is formed with an attaching hole 91 (for attaching the grip portion 73C to the mounting surface 24 of the main body 65), and the leg portion 71C and the grip portion 73C are attached to a predetermined position on the mounting surface 24 of the main body 65 using a fixed screw 79.

In addition, the same effect as that in the tray 3A according to the first embodiment is exerted when the tray 3C which is configured in this manner is used. Also, according to the embodiment, it is possible to adjust an attaching position of the leg portion 71C at a position where a worker comfortably works, and the carrying of the tray 3C becomes easy, since the grip portion 73C becomes easy to grab.

Other Embodiments

The tray, the ink jet textile printing apparatus, and the manufacturing method of a printed matter according to the embodiment of the invention are basically configured as described above. However, as a matter of course, it is also possible to perform partial changes in the configuration, omissions, or the like, without departing from the scope of the invention.

For example, the shape, the material, the numbers, and the like of the leg portion 71 are not limited to the configurations which are illustrated in the embodiments 1 to 3, and it is possible to adopt various configurations. It is possible to adopt a leg portion 71 of a rectangular block shape, a circular truncated cone shape, a truncated pyramid shape, a columnar shape, a prismatic shape, or the like. In addition, as a material, it is also possible to adopt various materials such as synthetic resin, wood, a gummy elastic material.

In addition, the number of leg portions 71 is not limited to four, and may be three, or it is possible to provide five or more leg portions. The attaching position of the leg portion 71 is not limited to a peripheral edge portion of the mounting surface 24 of the main body 65, and it is also possible to provide the leg portion 71 inside the peripheral edge portion.

(1) Number of Leg Portion

For example, the number of leg portions may be adjusted according to a tray size. Specifically, the leg portion is assumed to be increased according to an increase in size of the tray, for example, two for small size, three for medium size, four for large size. When the leg portions are two, a lower end of the leg portion is formed in a planar surface shape so as to be stably raised even with two leg portions. When the tray size increases, the weight of the tray increases according thereto. In such a case, when the tray is neglected for a long time, there is a concern that the tray may be deformed due to its own weight. Therefore, it is possible to suppress the deformation of the tray by increasing the leg portion according to the tray size.

When the tray size is small, there is a little concern of deforming of the tray compared to a large tray, since the small tray has a short distance between a center point and an end portion. Accordingly, a small leg portion is provided to a small tray in order to reduce cost, and to prevent an increase in weight.

(2) Attaching Position of Leg Portion

In addition, in the tray, the deformation of the tray due to its own weight becomes serious at the four corner portions, which are distant from the center point. Accordingly, by arranging the leg portion at a position which is closer to the corner, it is possible to suppress the deformation of the tray.

(3) Attaching Method of Leg Portion

According to the above described embodiments, the leg portion 71 is provided in a protruding manner in the same direction as the positioning pin 67 from the mounting surface 24 of the main body 65. However, for example, there may be a configuration in which the leg portion 71 protrudes from the side surface of the main body 65, that is, the leg portion 71 is screwed to the side surface of the main body 65, and is protruded in the same direction as the positioning pin 67 from the side surface of the main body 65.

In addition, as a material of the main body 65, for example, it is possible to use a transparent synthetic resin flat plate material such as an acrylic plate. However, it is also possible to use an opaque synthetic resin flat material, wood, aluminum flat plate material, or the like. In addition, it is also possible to configure the main body 65 using a composite material in which a strengthened frame of aluminum, or stainless steel is provided in the periphery of the acrylic synthetic resin flat plate, or the like.

In addition, when the weight of the tray 3 is light, it is also possible to provide a locking unit of a screw type, or a clamp type which fixes the tray 3 on the attachment unit 47 after placing the tray 3 on the attachment unit 47, in order to prevent the tray 3 in the middle of printing from being lifted.

In addition, according to the embodiments, a fabric is used as the material to be printed, however, paper or wood, a medium such as a film, or the like may be used.

What is claimed is:

1. A tray which is provided so as to be detachable from a support unit of an ink jet textile printing apparatus, comprising:

a main body having a setting surface on which a material to be printed is set;

a first protrusion portion which is inserted in a hole of the support unit when attaching the main body to the support unit, the first protrusion portion extending from a surface opposite side to the setting surface in a protruding manner; and a leg portion which is provided so as to protrude to the side which is opposite to the setting surface, and of which a protruding dimension is longer than that of the first protrusion portion, wherein the leg portion includes an inclined surface which retreats toward the inside from an end portion of the main body.

2. The tray according to claim 1, wherein a plurality of the leg portions are provided.

3. The tray according to claim 1, further comprising:

a frame which is fitted into the main body in a state of being set with the material to be printed on the setting surface, and maintains the set state of the material to be printed.

4. An ink jet textile printing apparatus comprising:

the tray according to claim 1;

a support unit at which the tray is detachably mounted; and an ink ejecting unit which ejects ink onto a material to be printed which is set in the tray.

5. The ink jet textile printing apparatus according to claim 4, further comprising:

a movement mechanism which relatively moves the ink ejecting unit with respect to the tray in a first direction, wherein the tray includes the plurality of trays of which length in the first direction is different, and wherein length of the leg portion in the first direction is shorter than length of a first tray in the first direction of which the length in the first direction is shortest among the plurality of trays.

6. The ink jet textile printing apparatus according to claim 5, wherein the length of the leg portion in the first direction is longer than a distance of a second tray of which length in the first direction is longest among the plurality of trays between the first protrusion portion and an end portion in the first direction.

7. A manufacturing method of a printed matter comprising:

setting a material to be printed onto the setting surface in a state in which the tray according to claim 1 is raised using the leg portion by being detached from a support unit of an ink jet textile printing apparatus;

arranging the tray in the support unit, subsequently; and executing printing.

8. A tray which is provided so as to be detachable from a support unit of an ink jet textile printing apparatus, comprising:

a main body having a setting surface on which a material to be printed is set;

a first protrusion portion which is inserted in a hole of the support unit when attaching the main body to the support unit, the first protrusion portion extending from a surface opposite side to the setting surface in a protruding manner; and a leg portion which is provided so as to protrude to the side which is opposite to the setting surface, and of which a protruding dimension is longer than that of the first protrusion portion, wherein the setting surface of the main body is provided with a concave portion at which the leg portion is located when a plurality of trays are overlapped.

9. A method of storing a tray comprising:

storing the tray according claim 8 by accumulating on top of another, by placing a leg portion of a tray on top in a concave portion of a tray below.

* * * * *